United States Patent [19]

Niemelä et al.

[11] Patent Number: 5,031,515

[45] Date of Patent: Jul. 16, 1991

[54] METHOD FOR REGULATION OF VENTILATION AS WELL AS AN AIR-CONDITIONING DEVICE USED IN THE METHOD

[75] Inventors: Mertsi Niemelä, Kuusankoski; Harri Jantunen, Kouvola, both of Finland

[73] Assignee: Halton Oy, Finland

[21] Appl. No.: 424,253

[22] PCT Filed: Jan. 20, 1989

[86] PCT No.: PCT/FI89/00010

§ 371 Date: Nov. 20, 1989

§ 102(e) Date: Nov. 20, 1989

[87] PCT Pub. No.: WO89/07738

PCT Pub. Date: Aug. 24, 1989

[30] Foreign Application Priority Data

Feb. 18, 1988 [FI] Finland ..... 880772

[51] Int. Cl.[5] ..... F24F 7/08

[52] U.S. Cl. ..... 98/34.6

[58] Field of Search ..... 98/34.5, 34.6, 38.7, 98/38.8

[56] References Cited

U.S. PATENT DOCUMENTS 1,858,024 5/1932 Moore ..... 98/34.5

3,130,908 4/1964 Henne ..... 98/34.5 X 3,472,148 10/1969 Winnett ..... 98/34.5

FOREIGN PATENT DOCUMENTS 0146488 6/1985 European Pat. Off. .

OTHER PUBLICATIONS

FLAKT TEKNIK AB, May 1984, Stenstorp, Enhetsaggregat VKAG, VKUG p. 19, p. 2.

*Primary Examiner*—Harold Joyce

*Attorney, Agent, or Firm*—Steinberg & Raskin

[57] ABSTRACT

A method for regulation of ventilation, wherein air is removed out of a room space (H) or equivalent through an air-conditioning device (10) as outlet air ($L_1$) and in which said air-conditioning apparatus (10) part of the outlet air is recirculated as return air ($L_2$) back into the room space, whereby return air ($L_2$) is mixed with outdoor air to be passed into the room space. Before the outlet air ($L_1$) is made to flow via the return-air damper (15) to the point of mixing (C) of return air ($L_2$) and outdoor air, the outlet air is fitted to flow first via the outlet-air damper (14) placed on the outlet-air duct (11*a*) and, thereupon, via the return-air damper (15). The portion ($L_3$) of the outlet air ($L_1$) that is not recirculated via the return-air damper (15) or equivalent is removed as waste air ($L_3$), without throttling, out of the air-conditioning device. The invention also concerns an air-conditioning apparatus.

10 Claims, 3 Drawing Sheets

METHOD FOR REGULATION OF VENTILATION AS WELL AS AN AIR-CONDITIONING DEVICE USED IN THE METHOD

BACKGROUND OF THE INVENTION

The invention concerns a method for regulation of ventilation as well as an air-conditioning device used in the method.

A method for regulation of ventilation is known wherein the indoor air is circulated so that at least a portion of the indoor air, a so-called return-air portion, is mixed with the outdoor air passed into the room. The proportion of outdoor air can be regulated within the range of 0 to 100 percent, i.e., in extreme cases, either all the air passed into the room consists of outdoor air or of recirculated return air.

In the prior-art, traditional mixing-regulation methods, generally, three dampers are used such that at least two dampers are interconnected mechanically or electrically such that, when the return-air damper is opened, the outdoor-air damper and the waste-air damper are closed to a corresponding extent. The possible changes in the turning angles of the dampers are within the range of 0 . . . 90°.

A problem in the prior-art mixing ventilation methods and in the apparatus used in these methods has been the poor controllability of the inlet and outlet air flows. The control of the mixing ratio and of the mixing degree has not been adequate. The inlet and outlet air flows have been changed by as much as 30 percent while the mixing ratio of outdoor air and return air has been changed within the range of 0 . . . 100 percent. Moreover, in the prior-art methods and apparatuses, it has not been possible to define or, thus, to control the mixing ratio of outdoor air to return air. For example, if it has been desired that the ratio of outdoor air to return air is ⅓, in reality this ratio has been 2/1. In such a case, the amount of outdoor air has been a multiple of the desired amount of outdoor air. Moreover, the overall inlet air quantity has still been 20 to 30 percent larger than the desired overall air quantity. A situation of the sort described above causes a considerable variation in the pressure ratios in an air-conditioning plant as well as a significant increase in the energy requirements.

The mixing of outdoor air and return air, i.e. their mixing degree, has also been problematic in the prior-art air-conditioning methods and apparatuses. When attempts have been made to mix warm return air and cold outdoor air, the mixed air, however, remains in layers so that the warm air flows in the upper portion of the duct and the cold air in its lower portion. This causes problems in particular in a heating radiator, because in such a case the bottom portion of the radiator tends to be frozen.

In traditional embodiments of mixing units, it has become a further problem that, with higher proportions of return air, the inlet and outlet air blowers become connected in series from the point of view of air flow. This causes an increase in the amounts of air both in the inlet-air ducts and in the outlet-air ducts. An increase in the amounts of air causes an increase in the speed of rotation of the blower and, consequently, of its motor, and thereby an increase in the amount of electric current used by the blower. When certain limit values of electric current are exceeded, the over-current protection switches are activated and the whole system stops.

SUMMARY OF THE INVENTION

The object of the invention is to overcome the drawbacks mentioned heretofore and to provide such a ventilation method and such an air-conditioning apparatus used in the ventilation method by means of which the inlet-air and outlet-air flows, the mixing ratio, and the mixing degree are controlled.

The object of the invention has been achieved by means of a ventilation method which is mainly characterized in that, before the outlet air is made to flow via the return-air damper to the point of mixing of return air and outdoor air, the outlet air is fitted to flow first via the outlet-air damper placed in the outlet-air duct and, thereupon, via the return-air damper, and the portion of the outlet air that is not recirculated via the return-air damper or equivalent is removed as waste air, without throttling, out of the air-conditioning device.

The air-conditioning apparatus in accordance with the invention is mainly characterized in that the apparatus comprises an outlet-air damper placed in the outlet-air duct, which outlet-air damper is fitted to be placed before the return-air damper, in relation to the air flow, whereby the portion of the outlet air that does not flow as return air into the inlet-air duct is removed out of the device as waste air.

By means of the ventilation method in accordance with the invention, constant flows of inlet air and outlet air have been achieved irrespective of the mixing ratios. By means of the method and the apparatus in accordance with the invention, a controlled degree of mixing of fresh air and return air has been obtained. No formation of temperature layers can be noticed. Moreover, according to the invention, such a ventilation method has been achieved that the mixing ratio is changed in a linear way in accordance with a control message given as a set value.

According to the invention, such a method for regulation of ventilation and such an air-conditioning apparatus used in the regulation method have been constructed that the outlet-air damper is fitted to be located before the point of branching of the waste-air flow and the return-air flow. The waste-air flow is fitted to be removed out of the device into the open air so that the flow is not choked. Although the waste-air duct may comprise a separate damper that closes and opens this duct, but the function of the damper is only to act as a closing member in said duct portion, operating by the on-off principle. Thus, in the closed position, free flow from open air through the waste-air duct is prevented. The return air is fitted to enter into the mixing point in the device, i.e. into the so-called mixing unit, at a very high speed. This high velocity is effectuated so that the cross-sectional flow are of the return-air duct or duct opening is made smaller than that of the outdoor-air duct. Under these circumstances, the area of the return-air damper is optimally about ⅓, i.e. about 30%, of the area of the outdoor-air damper, and advantageously also about 30% of the area of the outlet-air damper. Instead, of the areas of the dampers, it is also possible to speak of the cross-sectional flow areas of the duct portions placed facing the dampers, i.e. the cross-sectional flow area of the duct placed facing the return-air damper is optimally about 30% of the cross-sectional flow area of the duct placed facing the outdoor-air damper and advantageously also about 30% of the cross-sectional flow area of the duct placed facing the outlet-air damper. Thus, even with low circulation pressures a sufficiently rapid flow is obtained at the mixing point. Thus, the mixing degree, i.e. the mixing of the return air and the outdoor air becomes adequate. Under these circumstances, there are no temperature layers, which is the case in the prior-art solutions of equipment. The apparatus in accordance with the invention is also given such a control quantity as a set value as indicate directly the desired percentage proportion of fresh air in the inlet air to be passed into the room. The control unit, in which the functions that effectuate a linear control have been preset, regulates the desired opening positions of the dampers in particularly for the return-air damper and for the outdoor-air damper and for the outlet-air damper. In the present application, when dampers are spoken of, what is meant is generally valves that regulate flow of air.

BRIEF DESCRIPTION OF THE DRAWINGS

In the following, the invention will be described with reference to some preferred embodiments of the invention illustrated in the figures in the accompanying drawings, the invention being, however, not to be assumed to be confined to said embodiments alone.

DESCRIPTION OF THE PREFERRED EMBODIMENTS

Figure 1:
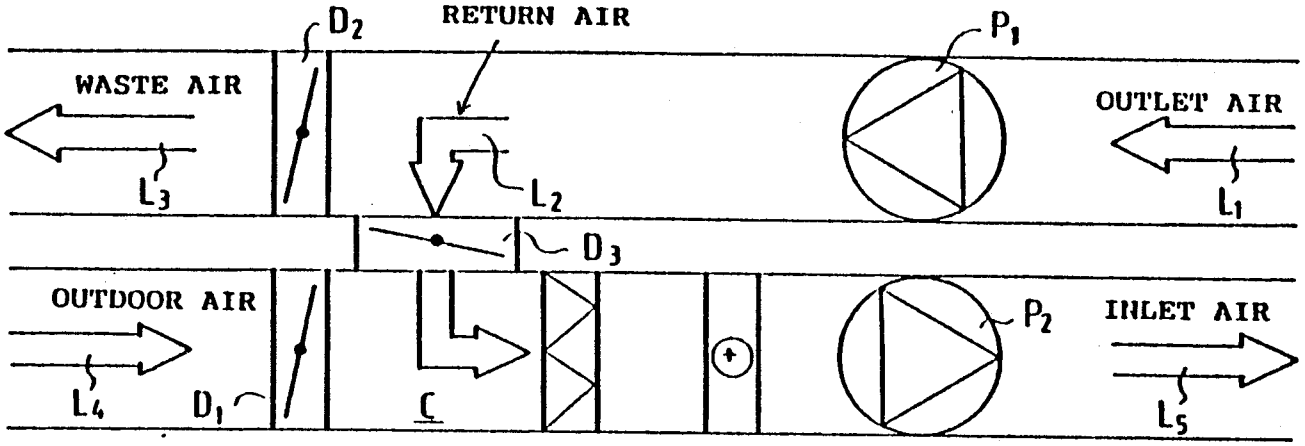
FIG. 1 PRIOR ART
FIG. 1 illustrates a prior-art ventilation method and an air-conditioning machine used in the method. The illustration is schematical.

FIG. 1 illustrates a method and a device in accordance with the prior art. The blower $P_1$ makes the outlet air flow in the way shown by the arrow $L_1$. Part of the air quantity $L_1$ is branched as return air $L_2$ via the return-air damper $D_3$ to the mixing point C. Part $L_3$ of the outlet air is removed as waste air to the open air. The blower $P_2$ makes outdoor air $L_4$ flow via the outdoor-air damper $D_1$ to the mixing point C, and in this way the return air $L_2$ and the outdoor air $L_4$ are mixed and carried further as a combined air flow $L_5$ into the room space as inlet air.

The waste-air damper $D_2$ is fitted to be placed after the return-air damper $D_3$, in relation to the direction of air flow. When return air is circulated so as to be maximum amount while the outdoor-air damper $D_1$ is closed, while the return-air damper $D_3$ is fully open, and while the waste-air $D_2$ damper is closed, the blowers $P_1$ and $P_2$ are in series. In such a case, loading is produced in the blower $P_1$ as the suction effect of the blower $P_2$ attempts to rotate the blower $P_1$. When the outlet-air flow is far larger than the inlet-air flow, the flow attempts to rotate the blower $P_2$. In an extreme case, the blower $P_1$ or $P_2$ is overloaded, and the overload relays switch off the main electricity circuit and stop the system.

In the prior-art systems, the dampers $D_1$ and $D_3$ are, as a rule, controlled mechanically. The dampers $D_1$ and $D_3$ are interconnected in such a way that, when the return-air damper $D_3$ is opened to a certain extent, the outdoor-air damper $D_1$ and the waste-air damper $D_2$ are closed to a corresponding extent. By means of the prior-art regulation of this type, no controlled mixing ratio is, however, obtained. Whereas it has been desirable to obtain a mixing ratio of outdoor air to return air equal to, e.g., 1:3, in reality this ratio may have been 2:1. In this way, the amount of outdoor air has been multiple of the desired amount of outdoor air. Moreover, in the prior-art solutions, the overall inlet-air quantity has been 20 to 30% higher than the desired amount. This circumstance has caused a considerable variation in the pressure ratios in an air-conditioning installation as well as a significant increase in the requirement of energy.

In the prior-art solutions of equipment, the mixing of outdoor air and return air, i.e. their mixing degree, has not been at the desired level either. When attempts have been made to mix warm return air and cold outdoor air, the mixed air has, however, remained in layers. In such a case, the warm air flows in the upper portion of the duct and the cold air in the lower portion.

Figure 2:
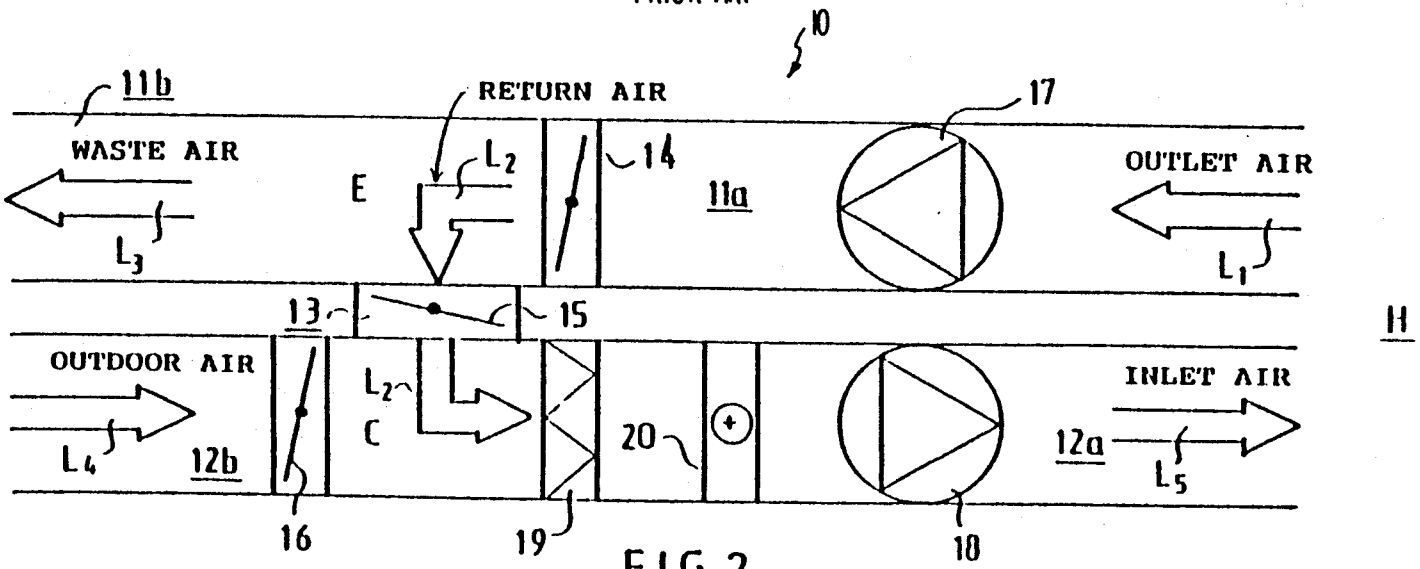
FIG. 2 is a partly schematical illustration of the ventilation method in accordance with the present invention and of an air-conditioning device used in the ventilation method.

FIG. 2 shows the ventilation method in accordance with the invention as well as illustrates the principle of the air-conditioning apparatus 10 in accordance with the invention. The air-conditioning apparatus 10 comprises an outlet-air duct 11*a* and an inlet-air duct 12*a*. Between these ducts, a connection duct 13 is provided for return air. At the end of the outlet-air duct 11*a* there is a waste-air duct 11*b*, and at the end of the inlet-air duct there is an outdoor-air duct 12*b*. According to the invention, an outlet-air damper 14 is fitted in the outlet-air duct 11*a*. The outlet-air damper 14 is fitted to be placed, in the direction of the outlet-air flow $L_1$, before the return-air damper 15 placed in the duct portion or duct opening 13 between the ducts 11*a* and 12*a*.

The outdoor-air damper 16 placed in the outdoor-air duct 12*b* is fitted to be located before the return-air damper 15, in the direction of the outdoor-air flow $L_4$. The apparatus further comprises a first blower 17 placed in the outlet-air duct 11*a* before the outlet-air damper 14. In a corresponding way, a second blower 18 is placed in the inlet-air duct 12*a*. The blower 18 is fitted to be located after the return-air damper 15. Between the return-air damper 15 and the second blower 18, for example, a filter 19 and a heat exchanger 20 may be fitted, which heat exchanger may be an air heater.

The equipment illustrated in FIG. 2 operates as follows. The first blower 17 is fitted to make the air flow, in the direction denoted with the arrow $L_1$, out of the room space H or equivalent, and the outlet air is made to flow in the outlet-air duct 11*a* via the outlet-air damper 14 that restricts the flow. After the outlet-air damper 14 the air enters into the duct space E at the front side of the return-air damper 15. The difference in pressure between the ducts 11*a* and 12*a* and the effect of the blower 17 that pushes the air flow and the effect of the blower 18 that sucks the air flow make the air flow in the manner denoted with the arrow $L_2$ back into the room space H through the inlet-air duct 12*a*. The portion of the outlet air $L_1$ that is not made to flow as recirculation air through the return-air damper 15 and the duct opening 13 into the inlet-air duct 12*a* is removed as waste air $L_3$ out of the ventilation device and preferably into the open air. The proportion of outdoor air in the inlet air $L_5$ that is made to flow in the duct 12*a* is regulated by means of the outdoor-air damper 16 placed in the outdoor-air duct.

It is characteristic of the device of the invention that the waste air is not throttled. It is an essential feature of the invention that the portion of the outlet air $L_1$ that is not circulated via the return-air damper 15 is removed without separate control as waste air in the way illustrated by the arrow $L_3$. Thus, the waste air does not have to be regulated separately, and the waste-air flow does not have to be throttled separately.

According to the invention, such a ventilation method and such an air-conditioning device are provided wherein, when the return-air damper 15 is being opened or closed, the outdoor-air damper 16 is opened or closed so that, when the amount of air that passes through the duct portion 13 is reduced by adjusting the return-air damper 15, the amount of outdoor air that passes via the outdoor-air damper 16 in the direction indicated by the arrow $L_4$ is increased by the corresponding amount. In a corresponding way, when the amount of return air that is made to flow through the duct 13 is increased by opening the return-air damper 15, the amount of outdoor air coming via the outdoor-air damper 16 is reduced by the corresponding amount by closing the outdoor-air damper 16. According to the invention, the control unit 22 carries out this regulation for the return-air damper 13 and for the outdoor-air damper 16 separately.

An effective characteristic curve is formed both for the return-air damper 15, for the outdoor-air damper 16, and for the outlet-air damper 14, and the effective characteristic curve is non-linearized inversely proportionally to the desired effective characteristic curve. In the ventilation method of the invention, the air-conditioning apparatus is given the desired percentage amount of outdoor air, calculated from the amount of inlet air $L_5$, as the initial setting. The controller 22 that carries out the linearization gives the dampers 16,15 and 14 the desired opening positions, which are essentially dependent on the effective characteristic curves of the dampers. An embodiment is also possible wherein a set value S is given as an initial setting which indicates the percentage of return air $L_2$ in the inlet air $L_5$. The rest of the inlet air $L_5$ consists of outdoor air $L_4$. The controller in accordance with the invention regulates the outdoor-air damper 16 and the return-air damper 15 so that, when the air flow via the outdoor-air damper 16 is reduced by a certain amount, the air flow via the return-air damper 15 is increased by the corresponding amount. In a corresponding way, when the air flow via the outdoor-air damper 16 is increased, the air flow via the return-air damper 15 is reduced by the corresponding amount. The linear regulation of the mixing ratio is also effectuated such that the outlet-air flow $L_1$ and the inlet-air flow $L_5$ remain within pre-adjusted desired constant values. The outdoor-air damper 16 is fitted to be located before the mixing point C of the return-air flow $L_2$ and the outdoor-air flow $L_4$. Viewed relative to the outdoor-air flow $L_4$.

For example, when a control quantity of 70% is given as the initial setting, the control unit 22 in accordance with the invention carries out the regulation such that it sets the return-air damper 15 and the outdoor-air damper 16 in such positions that the proportion of outdoor air in the inlet air $L_5$ becomes 70% of the inlet air $L_5$, whereas the proportion of the return air is 30% of the inlet air $L_5$. Thus, to the control unit, one control quantity S is fed, which indicates the percentage proportion of outdoor air in the inlet air $L_5$, and the control unit 22 in accordance with the invention adjusts the correct positions, determined on the basis of this control quantity, for the return-air damper 15, for the outdoor-air damper 16, and for the outlet-air damper 14.

The regulation of the outlet-air damper 14 takes place as follows. When the proportion of outdoor air starts being reduced from 100% downwards, thereby the proportion of return air starts increasing from 0% upwards. At the initial stage of the regulation the outlet-air damper 14 is fully open, and during the regulation the outlet-air damper 14 starts being closed in order that the amount of outlet air ($L_1$) should remain invariable in spite of the fact that the blower 17 placed in the outlet-air duct and the blower 18 placed in the inlet-air duct become connected ever increasingly in series as the flow of return air is increased. The outlet-air damper 14 prevents reduction of the pressure at the pressure side of the blower 17 and increase in the pressure at the suction side of the blower 18 in particular cases in which the return-air circulation is at the maximum. In this way, an overloading of the motors of the blowers 17 and 18 is prevented when the blowers 17 and 18 are connected in series relative to the air flow.

The control of the device in accordance with the invention takes into account the requirement of outdoor air in cases in which the amounts of outlet air and inlet air are different, for example the amount of outlet air is lower than the amount of inlet air. For example, when the amount of outlet air is 20% lower than the amount of inlet air, the minimum proportion of outdoor air becomes 20% of inlet air. In other words, the whole of the outlet air is run as return air, but additionally a proportion of 20% of outdoor air is required in order that 100% of the inlet-air amount can be reached.

In a situation opposite to that described above, when the flow of outlet air is higher than the flow of inlet air, the outlet-air damper 14, the return-air damper 15, and the outdoor-air damper 16 are controlled so that the maximum of the return air is equal to the amount of inlet air, and the excess air is passed out of the device as waste air.

In a so-called situation of forcible control, e.g. in night-time heating operation, it is also possible to use 100% of return air, in which case the amounts of outdoor air and waste air are 0%. In such a case, the return-air damper 15 and the outlet-air damper 14 are controlled such that the amount of air circulated in the device 10 is regulated to be equal to the amount of inlet-air flow if the latter amount is smaller than the amount of outlet-air flow, or as equal to the amount of outlet-air flow if the latter amount is smaller than the amount of inlet-air flow.

In each installation, the control unit comprises system-specific parameters, by means of which the control unit defines the control curves important for it in view of the operation of the mixing part C as well as said control curves separately for each damper. These control curves are defined so that an effective characteristic curve is non-linearized inversely proportionally to the desired effective characteristic curve. The control unit 22 is aware of the opening position of each damper at each particular time. According to the invention, it is also possible to use a control unit of its own for each damper. In such a case, the control units are in data communication with each other and give the dampers 14,15 and 16 the operating positions determined by the percentage proportion of outdoor-air quantity in the inlet air $L_5$, given as the set value.

The outdoor-air damper 16 and the return-air damper 15 are substantially perpendicular to each other. In a corresponding way, the return-air damper 15 and the outlet-air damper 14 are substantially perpendicular to each other. That means that the air flows that pass through the dampers 15 and 16 and the central axes of the ducts in which the dampers 15 and 16 are placed are perpendicular to each other. In a corresponding way, the return-air damper 15 is perpendicular to the outlet-air damper 14, i.e. the central axis of the duct 13 is substantially perpendicular to the central axis of the duct 11*a*. It is also essential that the return-air damper 15 is placed at the proximity of the outdoor-air damper 16. In a case in which the duct 13 does not consist of a through opening only, but of a longer duct portion, the return-air damper 15 is placed at the end next to the outdoor-air damper 16. The area of the return-air damper 15 is substantially smaller than the areas of the outdoor-air damper 16 and of the outlet-air damper 14. An optimal ratio of the areas of the return-air damper 15 and the outdoor-air damper 16 is 1:3, i.e. the area of the return-air damper 15 is about 30% of the area of the outdoor-air damper 16. In a corresponding way, an optimal ratio of the areas of the return-air damper 15 and the outlet-air damper 14 is about 1:3, i.e. the area of the return-air damper 15 is about 30% of the area of the outlet-air damper 14. The ratios of areas may, in this connection, also refer to the cross-sectional flow areas of the ducts placed facing said dampers. Maximum ranges of variation of the above ratios or areas are 10% to 75%. As the cross-sectional flow area at the return-air damper 15 is smaller than at the other dampers, and in particular at the outdoor-air damper 16, the flow in the duct 13 always has an adequate velocity even with low differences in pressure, and at the mixing point an adequate degree of mixing of outdoor air and return air is always obtained, and, thus, no formation of layers of temperature occurs. Thus, the locations and the ratios of areas of the dampers have a substantial effect on the mixing degree. Thus, the mixing degree can be effectively controlled. With the device in accordance with the invention, no formation of temperature layers can be noticed. $\Delta T = 0 \ldots 2°$ C. across the entire flow cross-section after the mixing point C of the return-air flow $L_2$ and the outdoor-air flow $L_4$.

Figure 3:
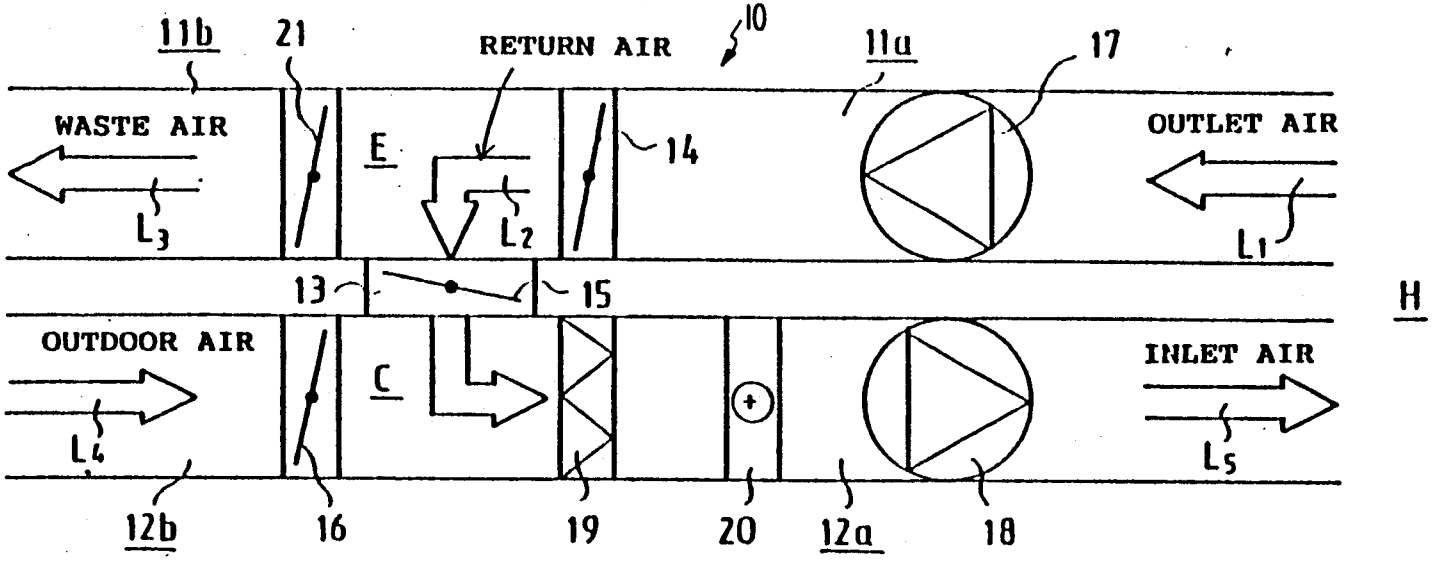
FIG. 3 illustrates a second preferred embodiment of the invention.

FIG. 3 illustrates a second preferred embodiment of the invention, wherein the equipment comprises a fourth damper 21, which is fitted to regulate the waste-air flow $L_3$ by the on-off principle. The function of this damper is not to throttle the waste-air flow $L_3$, but its function is just to close the waste-air duct 11*b* particularly in cases in which all the outlet air is recirculated as return air into the duct 12*a*. Thus, the damper 21 is either closed or open. During said maximum return-air circulation, it is preferable to keep the damper 21 closed expressly in order that outdoor air cannot be mixed with the return air $L_2$ through the waste-air duct. Also, in cases in which the ventilation device is out of operation, the connection to the outdoor air is closed by means of the dampers 21 and 16, and free flow through the dampers 21 and 16 is excluded.

Figure 4A:
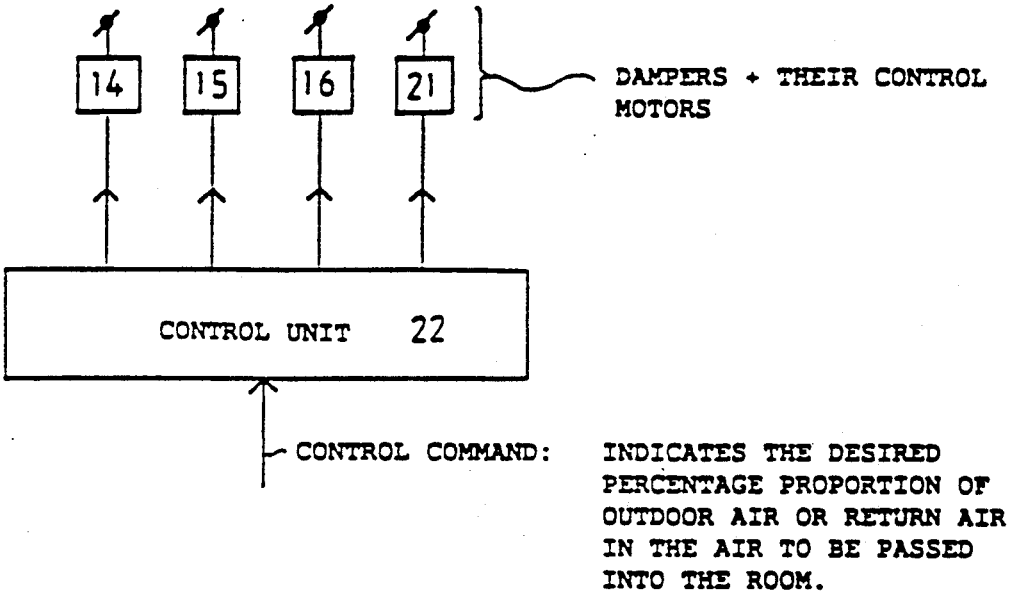
FIG. 4A is a block diagram illustration of a preferred embodiment of the control unit.

FIG. 4A is a block-diagram illustration of the principle of the ventilation method in accordance with the invention and of the related control unit. A control quantity S is set in the control unit 22 as a set value. The control quantity S indicates the desired percentage proportions of the amount of outdoor air or of the amount of return air in the inlet air $L_5$. The control unit 22 adjusts each damper 14,15,16 and/or 21 separately. There are no mechanical couplings, levers, rods, or electric slave action between said dampers. Thus, each damper is regulated independently.

By means of the control unit 22 in accordance with the invention the flows of inlet air and outlet air remain constant irrespective of the mixing ratio. The mixing ratio (amount of outdoor air to amount of return air) is altered in a linear way in accordance with the message S that controls the mixing ratio. The control unit 22 regulates the outdoor-air damper and the return-air damper so that, when the amount of air flowing via the outdoor-air damper is increased, the amount of air flowing via the return-air damper is reduced by the corresponding amount and, in a corresponding way, when the amount of air flowing via the outdoor-air damper is reduced, the amount of air flowing via the return-air damper is increased by the corresponding amount. The addition to the linear regulation of the mixing ratio, the control unit 22 also accomplishes regulation of the device so that the outlet-air flow $L_1$ and the inlet-air flow $L_5$ always remain at the desired preset and pre-adjusted value.

Figure 4B:
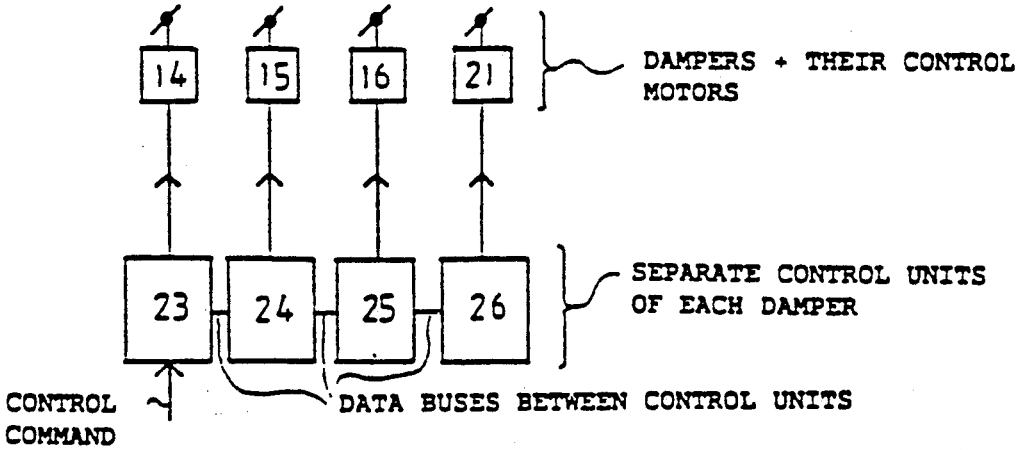
FIG. 4B shows a second embodiment of the control unit.

FIG. 4B illustrates a second embodiment of the control of the dampers. For each damper 14,15,16 and 21 there is a control unit 23,24,25 and 26 of its own. The control units are interconnected by means of data buses 27. The set value S, which indicates the desired percentage proportion of outdoor-air flow in the entire inlet air $L_5$ to be passed into the room space H, is given to one or, alternatively, to several control units 23,24,25 and 26, which thus give the actuators that regulate the positions of the dampers 14,15,16 and 21 the positions that accomplish the desired flow of inlet air $L_5$.

What is claimed is:

1. A method for regulation of ventilation, said method comprising the steps of removing air out of a room space through an air-conditioning device as outlet air and in said air-conditioning device, recirculating part of the outlet air as return air back into the room space, whereby said return air is mixed with outdoor air to be passed into the room space wherein, before the outlet air is made to flow via a return-air damper to the point of mixing of return air and outdoor air, causing the outlet air to flow first through a blower and then through an outlet-air damper placed in one outlet-air duct and, thereupon, via the return-air damper, and simultaneously removing as waste air the portion of the outlet air that is not recirculated via the return-air damper, without throttling, out of the air-conditioning device.

2. The method of claim 1, comprising using such a damper control unit as is given a control quantity which indicates the desired proportion of outdoor air or of return air in the inlet air to be passed into the room, and which said control unit adjusts, for the dampers, positions that effectuate a given set value, and fitting the control unit to regulate each damper separately.

3. The method of claim 1, comprising using such a control unit for controlling the dampers such that, when the amount of outdoor air that flows via the return-air damper is reduced by a corresponding amount and, when the amount of air that flows via the outdoor-air damper is reduced, the amount of air that flows via the outlet-air damper is increased by a corresponding amount, and in said controlling, keeping the amounts of inlet-air flow and outlet-air flow at a desired preset value.

4. An air-conditioning apparatus which comprises an outlet-air duct and therein a first blower, and an inlet-air duct and therein a second blower, and a return-air duct which interconnects said ducts and through which return air is recirculated from the outlet-air duct into the inlet-air duct, and said air-conditioning apparatus comprises a waste-air duct connected to said outlet-air duct and the apparatus comprises an outdoor-air duct connected to said inlet-air duct, and said apparatus comprises a return-air damper in said return-air duct and an outdoor-air damper in the outdoor-air duct, and wherein said apparatus further comprises an outlet-air damper placed in the outlet-air duct, said outlet-air damper placed in the outlet-air duct such that said return air passes through said outlet-air damper before passing through said return air duct, and said outlet-air damper being positioned after said first blower in the direction of air flow, said outlet-air damper being fitted to be placed before the return-air damper, relative to the air flow, whereby the portion of the outlet air that does not flow as return air into the inlet-air duct is removed from the apparatus as waste air without throttling, whereas the return air is mixed with an outdoor-air flow introduced along the outdoor-air duct.

5. The air-conditioning apparatus of claim 4, wherein the outdoor-air damper is fitted to be placed before the point of mixing of the return-air flow and the outdoor-air flow.

6. The air-conditioning apparatus of claim 4, further comprising a fourth damper, which operates under an open/close principle, wherein in the open position a free unthrottled flow is permitted via the fourth damper, and said fourth damper being placed in the waste-air duct after the point of branching of the waste-air flow and the return-air flow.

7. The air-conditioning apparatus of claim 4, wherein, at the return-air damper, the cross-sectional flow are of the return-air duct is 10% to 75%, of the cross-sectional flow area of the outlet-air duct.

8. The air-conditioning apparatus of claim 4, wherein the connecting duct and the outdoor-air duct are placed so that their central axes are substantially perpendicular to each other, and that the return-air damper fitted in the return-air duct opening is adapted to be placed in the proximity of the outdoor-air damper.

9. The air-conditioning apparatus of claim 4 wherein the air-conditioning apparatus further comprises a control unit, to which a control quantity which indicates the desired proportion of outdoor air in the inlet air is fed as a set value, and which said control unit regulates each damper separately, and that said control unit regulates the dampers such that, when the flow of air flowing through the outdoor-air damper is increased, the flow of air flowing through the return-air damper is reduced by a corresponding amount, and, in a corresponding manner, when the flow of air flowing through the outdoor-air damper is reduced, the flow of air flowing through the return-air damper is increased by a corresponding amount, and that, when said air flows are being regulated, the outlet-air flow and the inlet-air flow ($L_1$, $L_5$) are kept at respective pre-adjusted desired flow-quantity values.

10. The air-conditioning device of claim 7, wherein said cross-sectional flow area of said return-air duct is about 30% of the respective cross-sectional flow areas of the outdoor-air duct and the outlet-air duct.

* * * * *